US008686655B2

(12) United States Patent
Setomoto et al.

(10) Patent No.: US 8,686,655 B2
(45) Date of Patent: Apr. 1, 2014

(54) LIGHTING CIRCUIT, LAMP, AND ILLUMINATION APPARATUS

(75) Inventors: Tatsumi Setomoto, Osaka (JP); Tamotsu Ando, Osaka (JP); Kazushige Sugita, Hyogo (JP)

(73) Assignee: Panasonic Corporation, Osaka (JP)

( * ) Notice: Subject to any disclaimer, the term of this patent is extended or adjusted under 35 U.S.C. 154(b) by 141 days.

(21) Appl. No.: 13/392,050

(22) PCT Filed: Jul. 21, 2011

(86) PCT No.: PCT/JP2011/004128

§ 371 (c)(1),
(2), (4) Date: Feb. 23, 2012

(87) PCT Pub. No.: WO2012/011288

PCT Pub. Date: Jan. 26, 2012

(65) Prior Publication Data

US 2012/0153854 A1 Jun. 21, 2012

(30) Foreign Application Priority Data

Jul. 22, 2010 (JP) ..... 2010-164824

(51) Int. Cl.
*H05B 37/00* (2006.01)

(52) U.S. Cl.
USPC ..... 315/200 R; 315/201; 315/297

(58) Field of Classification Search
USPC ..... 315/200 R, 201, 228, 294, 297, 307, 315/185 R, 187
See application file for complete search history.

(56) References Cited

U.S. PATENT DOCUMENTS

| | | | | |
|---|---|---|---|---|
| 5,914,572 | A * | 6/1999 | Qian et al. | 315/307 |
| 6,639,491 | B2 | 10/2003 | Toncich | |
| 6,690,176 | B2 | 2/2004 | Toncich | |
| 6,690,251 | B2 | 2/2004 | Toncich | |
| 6,727,786 | B2 | 4/2004 | Toncich | |
| 6,737,930 | B2 | 5/2004 | Toncich | |

(Continued)

FOREIGN PATENT DOCUMENTS

| | | |
|---|---|---|
| JP | 10-004688 | 1/1998 |
| JP | 10-225141 | 8/1998 |

(Continued)

OTHER PUBLICATIONS

Japanese Application No. 2012-503801 Office Action dated Jan. 29, 2013, 2 pages.

(Continued)

*Primary Examiner* — Daniel D Chang

(57) ABSTRACT

A lighting circuit that is for a lamp including an LED as a light source and that includes a resonant circuit that can be designed with ease. A lighting circuit 11 is for a lamp including a light-emitter 39 composed of an LED as a light source. The lighting circuit comprises: a rectifier circuit 31 that rectifies power supplied from an alternating current power supply via a base 28; an inverter circuit 33 connected to an output side of the rectifier circuit 31 and outputting alternating power to the LED; and a resonant circuit 35 connected to an output side of the inverter circuit 33, wherein the resonant circuit 35 includes an inductor L and a capacitor C1 and is connected in series with the light-emitter 39, the inductor L and the capacitor C1 being connected in series.

6 Claims, 10 Drawing Sheets

(56) References Cited

U.S. PATENT DOCUMENTS

| | | | |
|---|---|---|---|
| 6,741,211 | B2 | 5/2004 | Toncich et al. |
| 6,741,217 | B2 | 5/2004 | Toncich et al. |
| 6,744,327 | B2 | 6/2004 | Toncich et al. |
| 6,756,947 | B2 | 6/2004 | Toncich et al. |
| 6,765,540 | B2 | 7/2004 | Toncich |
| 6,816,714 | B2 | 11/2004 | Toncich |
| 6,819,194 | B2 | 11/2004 | Toncich et al. |
| 6,825,818 | B2 | 11/2004 | Toncich |
| 6,833,820 | B2 | 12/2004 | Toncich et al. |
| 6,859,104 | B2 | 2/2005 | Toncich et al. |
| 6,861,985 | B2 | 3/2005 | Toncich et al. |
| 6,867,744 | B2 | 3/2005 | Toncich et al. |
| 6,885,263 | B2 | 4/2005 | Toncich |
| 6,885,341 | B2 | 4/2005 | Tran et al. |
| 6,903,612 | B2 | 6/2005 | Toncich et al. |
| 6,909,344 | B2 | 6/2005 | Toncich |
| 6,927,644 | B2 | 8/2005 | Toncich |
| 6,937,195 | B2 | 8/2005 | Fabrega-Sanchez et al. |
| 6,970,055 | B2 | 11/2005 | Toncich |
| 7,009,455 | B2 | 3/2006 | Toncich et al. |
| 7,116,954 | B2 | 10/2006 | Toncich |
| 7,154,440 | B2 | 12/2006 | Toncich et al. |
| 7,164,329 | B2 | 1/2007 | Toncich et al. |
| 7,174,147 | B2 | 2/2007 | Toncich et al. |
| 7,176,845 | B2 | 2/2007 | Fabrega-Sanchez et al. |
| 7,180,467 | B2 | 2/2007 | Fabrega-Sanchez et al. |
| 7,184,727 | B2 | 2/2007 | Poilasne et al. |
| 7,221,243 | B2 | 5/2007 | Toncich et al. |
| 7,221,327 | B2 | 5/2007 | Toncich |
| 7,265,643 | B2 | 9/2007 | Toncich |
| 7,394,430 | B2 | 7/2008 | Poilasne et al. |
| 7,509,100 | B2 | 3/2009 | Toncich |
| 7,746,292 | B2 | 6/2010 | Poilasne et al. |
| 8,330,391 | B2 * | 12/2012 | Wendt et al. ..... 315/307 |
| 2002/0149443 | A1 | 10/2002 | Toncich et al. |
| 2003/0122502 | A1 | 7/2003 | Clauberg et al. |
| 2009/0021175 | A1 * | 1/2009 | Wendt et al. ..... 315/200 R |
| 2009/0273301 | A1 | 11/2009 | De Anna et al. |
| 2010/0052566 | A1 | 3/2010 | Kitamura et al. |
| 2010/0127950 | A1 | 5/2010 | Poilasne et al. |

FOREIGN PATENT DOCUMENTS

| | | |
|---|---|---|
| JP | 2001-351789 | 12/2001 |
| JP | 2003-347828 | 12/2003 |
| JP | 2005-513819 | 5/2005 |
| JP | 2005-198335 | 7/2005 |
| JP | 2005-252661 | 9/2005 |
| JP | 2005-267899 | 9/2005 |
| JP | 2008-167474 | 7/2008 |
| JP | 2009-516922 | 4/2009 |
| JP | 2010-086943 | 4/2010 |

OTHER PUBLICATIONS

Japanese Application No. 2012-503801 Questioning dated Jun. 18, 2013, 1 page.

* cited by examiner

LIGHTING CIRCUIT, LAMP, AND ILLUMINATION APPARATUS

RELATED APPLICATIONS

The present application claims priority from PCT/JP2011/004128 filed on Jul. 21, 2011, which in turn claims priority from the Japanese Patent Application 2010-164824 filed on Jul. 22, 2010.

TECHNICAL FIELD

The present invention relates to a lighting circuit that is for a lamp utilizing LEDs as a light source, a lamp incorporating the lighting circuit, and an illumination apparatus incorporating the lighting circuit.

DESCRIPTION OF THE RELATED ART

In recent years, a bulb-type LED lamp, which utilizes LEDs as a light source and has an energy-saving characteristic, has been proposed as an alternative to an incandescent lamp. Note that a bulb-type lamp utilizing LEDs is referred to as an "LED lamp" in the following.

In an LED lamp, a lighting circuit for lighting LEDs is housed in a case having a base attached thereto. Examples of lighting circuits for lighting LEDs include: a circuit including an inverter circuit and a transformer (as disclosed in Patent Literature 1); and a circuit including an inverter circuit and a resonant circuit (as disclosed in Patent Literature 2).

Further, there has been an increasing desire in recent years for an LED lamp having a size suitable for attaching to a conventional lighting fixture originally used in combination with an incandescent lamp. In order to fulfill such a desire, which requires downsizing an LED lamp, a lighting circuit including a resonant circuit is being commonly utilized for LED lamps.

The lighting circuit disclosed in Patent Literature 2, which utilizes a resonant circuit, includes: a DC power supply circuit; an inverter circuit; and a resonant circuit including a series-connected inductor and capacitor. Further, multiple LEDs are connected in parallel with the capacitor of the resonant circuit.

CITATION LIST

Patent Literature

[Patent Literature 1]
Japanese Patent Application Publication No. 2009-516922
[Patent Literature 2]
Japanese Patent Application Publication No. 2010-086943

SUMMARY OF INVENTION

Technical Problem

In the above-described LED lamp, a predetermined number of LEDs (in the form of LED chips) are implemented on a substrate or the like as a light source. Further, the number of LEDs provided to the LED lamp is determined such that the LED lamp has the luminance and the wattage of a corresponding incandescent lamp.

Since the number of LEDs provided to the conventional lighting circuit including the above-described resonant circuit is determined according to the luminance and the like of the corresponding incandescent lamp as mentioned above, difficulty is experienced in the process of designing the resonant circuit.

Such a difficulty arises since there are multiple types of incandescent lamps (for instance, incandescent lamps having wattages of 40 W, 60 W, and 100 W), each of which having a different level of luminance. Due to this, the number of LEDs to be provided to the LED lamp needs to be determined according to the luminance of the corresponding type of incandescent lamp. In other words, a lighting circuit for an LED lamp corresponding to one type of incandescent lamp cannot be immediately used in an LED lamp corresponding to another type of incandescent lamp.

In addition, since the multiple LEDs included in the conventional lighting circuit as described above are connected in parallel with the capacitor included in the resonant circuit, the design of the resonant circuit is restricted not only by the inductor and the capacitor, but also by the number of LEDs and the like.

As such, the design of a lighting circuit to be provided to an LED lamp corresponding to a given type of incandescent lamp is determined according to the number of LEDs required to realize the luminance and the like of the corresponding type of incandescent lamp. More specifically, a specification of a resonant circuit to be included in the lighting circuit is determined according to (i) the number of LEDs to be provided to the LED lamp and the characteristics of the capacitor, which is influenced by the number of LEDs to be connected in parallel therewith, and (ii) the characteristics of the inductor. Hence, the specification of the resonant circuit needs to be determined separately each time the number of LEDs to be provided to the LED lamp changes, and therefore, the complexity of the process of designing the resonant circuit increases.

In view of the above-presented problems, one aim of the present invention is to provide a lighting circuit that is for a lamp including LEDs as a light source and that includes a resonant circuit that can be designed with ease.

Solution to the Problems

The present invention provides a lighting circuit that is for a lamp including an LED as a light source, the lighting circuit comprising: a rectifier circuit that rectifies power supplied from an alternating current power supply; an inverter circuit connected to an output side of the rectifier circuit; and a resonant circuit connected to an output side of the inverter circuit, wherein the resonant circuit includes an inductor and a capacitor and is connected in series with the LED, the inductor and the capacitor being connected in series.

Advantageous Effects of the Invention

According to the above-described configuration of the lighting circuit, the process of designing the resonant circuit is performed while taking only the inductor and the capacitor into consideration since the LEDs are connected in series to the resonant circuit. Hence, the process of designing the resonant circuit is facilitated.

The lighting circuit may further comprise a capacitor that is connected in parallel with the LED and, in the lighting circuit, the inverter circuit may be a half-bridge inverter including one pair of switching elements and one pair of coupling capacitors, and the capacitor included in the resonant circuit may be one coupling capacitor among the pair of coupling capacitors included in the inverter circuit.

Another aspect of the present invention is a lamp comprising: an LED as a light source; and a lighting circuit that causes the LED to illuminate, wherein the lighting circuit comprises the above-described lighting circuit.

Another aspect of the present invention is an illumination apparatus comprising: a lamp including an LED as a light source; and a lighting circuit that causes the LED to illuminate, wherein the lighting circuit comprises the above-described lighting circuit.

DESCRIPTION OF EMBODIMENTS

First Embodiment

In the following, detailed explanation is provided of a first embodiment for implementing the present invention with reference to the accompanying drawings.

1. Overall Structure

Figure 1:
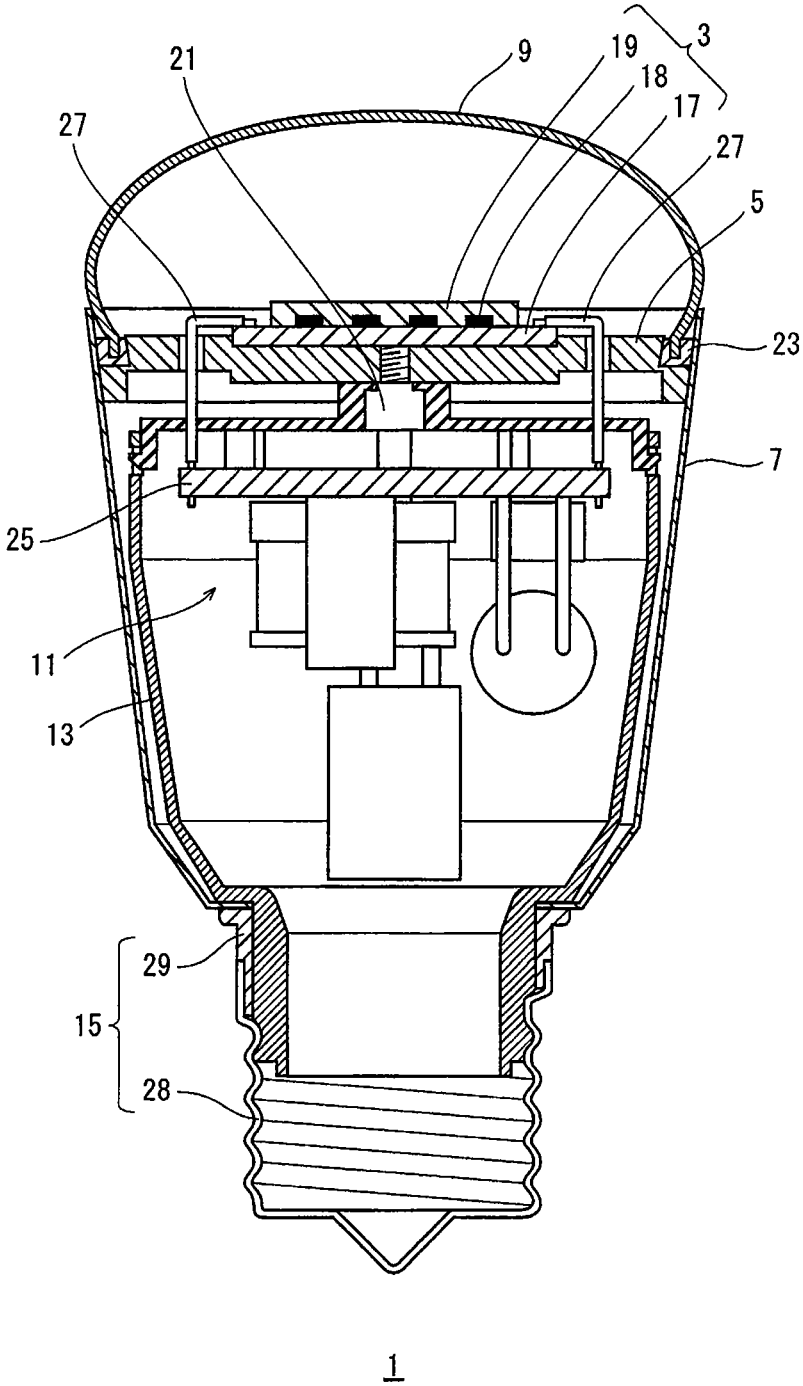
FIG. 1 is a cross-sectional view illustrating a structure of an LED lamp pertaining to a first embodiment.

FIG. 1 is a cross-sectional view illustrating a structure of an LED lamp pertaining to the first embodiment.

An LED lamp 1 (corresponding to the "lamp" pertaining to the present invention) includes: an LED module 3; a mounting member 5; a case 7; a globe 9; a lighting circuit 11; a circuit holder 13; and a base member 15. The LED module 3 includes LEDs 18 as a light source and is mounted on the mounting member 5 provided at one end of the case 7. The globe 9 covers the LED module 3. The lighting circuit 11 is for lighting the LEDs 18. The circuit holder 13 accommodates therein the lighting circuit 11 and is provided within the case 7. The base member 15 is provided at the other end of the case 7. The LED lamp 1 is a so-called bulb-type LED lamp.

(1) The LED Module

The LED module 3 includes: an insulating substrate 17; the LEDs 18 implemented on a surface of the insulating substrate 17; and a sealing body 19 covering the LEDs 18 on the insulating substrate 17. The sealing body 19 includes, as a main component thereof, a light transmissive material. In addition, when there is a need to convert the wavelength of light emitted from the LEDs 18 into a predetermined wavelength, a conversion material for converting the wavelength of light is mixed with the light transmissive material.

For example, silicone resin may be used as the light transmissive material, and phosphor particles may be used as the conversion material.

In addition, the LEDs 18 in connected-state is referred to as a light-emitter 39 since the LEDs 18 in such a state emit light and function as a light source.

(2) The Mounting Member

The mounting member 5, composed of a plate-like member, has the LED module 3 mounted on a surface thereof and seals the one end of the case 7. Detailed description concerning the case 7 is to be provided in the following.

The mounting member 5 is provided with a function of conducting heat to the case 7, and therefore, is formed by using a high thermal conductive material. Here, the heat conducted by the mounting member 5 is generated by the LEDs 18 in lit state. In the present embodiment, the mounting member 5 is a disc-shaped member, is press-fitted into the one end of the case 7, and is connected to the circuit holder 13 by a screw 21. In addition, a metallic material such as aluminum may be used as the high thermal conductive material, for example.

The mounting member 5 is formed so as to be provided with a step-like shape at an outer circumferential portion thereof, as illustrated in FIG. 1. Further, a groove is formed between the outer circumferential portion and the one end of the case 7. An end portion of an open-ended side of the globe 9 is fit into the groove, and further, the open-ended side of the globe 9 and the groove are adhered by the application of an adhesive agent 23 into the groove.

(3) The Case

The case 7 has a cylindrical shape, and the mounting member 5 is attached to the one end thereof, whereas the base member 15 is attached to the other end thereof The case 7 also has a function of receiving the heat generated by the LEDs 18 in lit state from the mounting member 5 and radiating the heat (that is, the case 7 functions as a so-called heat sink). Hence, the case 7 is formed by using a material having high thermal radiation properties. For example, metallic material such as aluminum may be used as the material having high thermal radiation properties.

Further, the case 7 accommodates therein a main body of the circuit holder 13. In addition, a portion of the circuit holder 13 protrudes from the other end of the case 7, and the base member 15 is attached to the protruding portion of the circuit holder 13.

(4) The Globe

The globe 9 is fit into the above-described groove formed by combining the mounting member 5 and the case 7, and is fixed (adhered) to the mounting member 5 and the case 7 by the adhesive agent 23 filled in the groove.

(5) The Lighting Circuit

The lighting circuit 11 is composed of various electronic components being implemented on the insulating substrate 25 and is accommodated within the circuit holder 13. In addition, an output terminal of the lighting circuit 11 is electrically connected to an input terminal of the LED module 3 via a wiring 27. Description concerning the circuit configuration of the lighting circuit 11 is to be provided in the following.

(6) The Circuit Holder

The circuit holder 13 is composed of an insulating material. For example, a synthetic resin (specifically, polybutylene terephthalate (PBT)) may be used as the insulating material.

(7) Base Member

The base member 15 is to be attached to a socket of a lighting fixture and to receive power via the socket. More specifically, the base member includes a base 28, which is an Edison base, and an insulating member 29 for insulation between the base 28 and the case 7.

The base member 15 is attached to the circuit holder 13 so as to cover the protruding portion of the circuit holder 13, which protrudes from an opening at the other end of the case 7. In addition, the base 28 and an input terminal of the lighting circuit 11 are electrically connected via a wiring (undepicted).

2. Circuit Configuration (1) Overview

Figure 2:
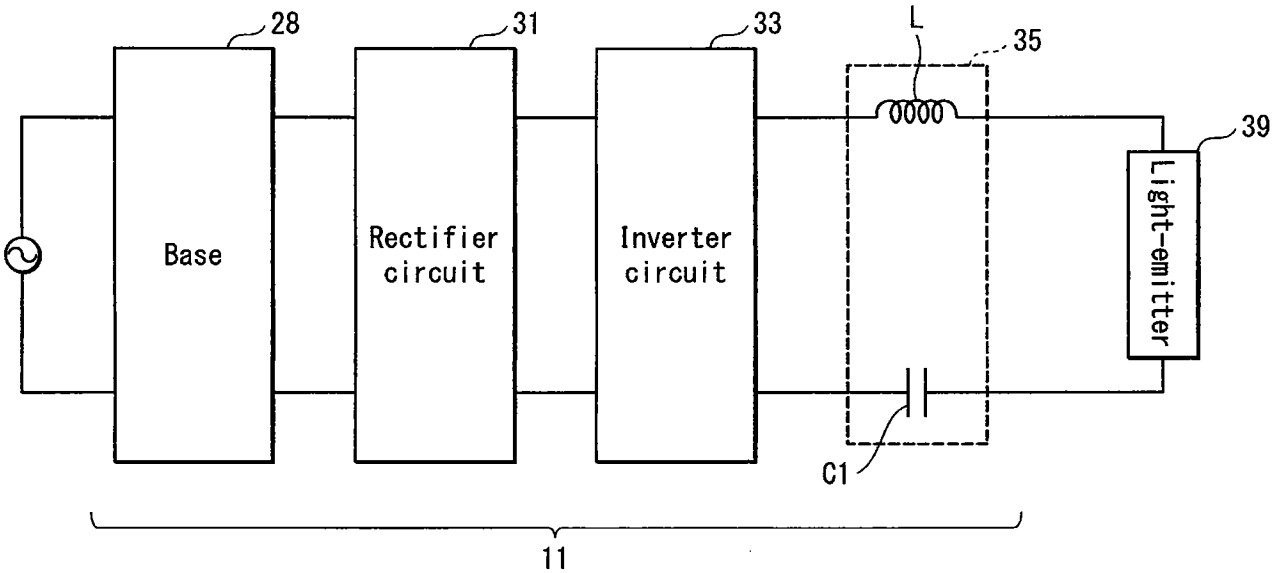
FIG. 2 is a block diagram illustrating a lighting circuit pertaining to the first embodiment.

FIG. 2 is a block diagram illustrating the lighting circuit pertaining to the present embodiment.

The LED lamp 1 includes, as the main components thereof: a rectifier circuit 31; an inverter circuit 33; and a resonant circuit 35. The resonant circuit 35 includes a choke coil L and a capacitor C1 connected in series. Further, multiple LEDs 18 are connected in series with the resonant circuit 35.

The rectifier circuit 31 rectifies commercial low-frequency alternating current and converts the alternating current into direct current. Further, the rectifier circuit 31 outputs direct current to the inverter circuit 33. Description of the specific configuration of the rectifier circuit 31 is to be provided in the following.

The inverter circuit 33 converts direct current output from the rectifier circuit 31 into high-frequency alternating current and outputs high-frequency alternating current to the resonant circuit 35. Description of the specific configuration of the inverter circuit 33 is to be provided in the following.

The resonant circuit 35 steps up voltage output from the inverter circuit 33 and outputs constant current to the light-emitter 39.

(2) Specific Structure

Figure 3:
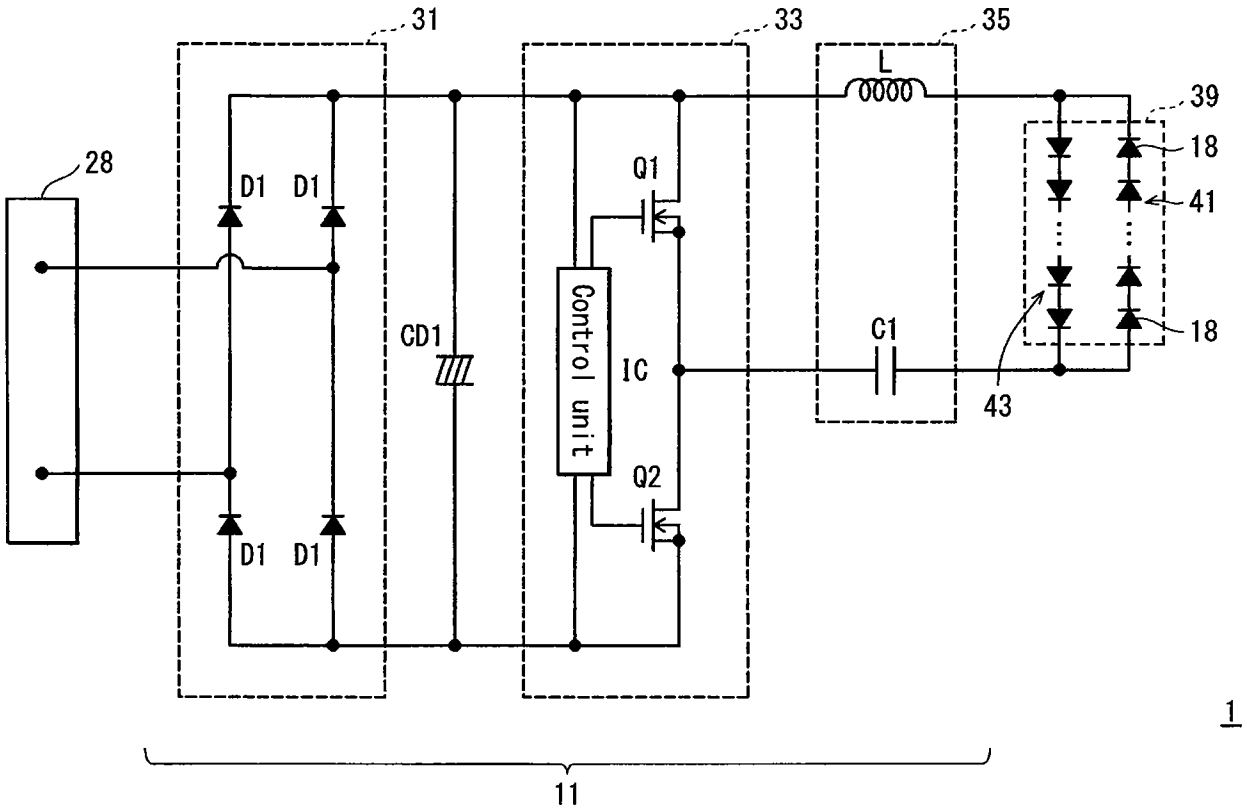
FIG. 3 is a circuit diagram illustrating a configuration of the lighting circuit pertaining to the first embodiment.

FIG. 3 is a circuit diagram illustrating a configuration of the lighting circuit pertaining to the present embodiment.

The rectifier circuit 31 is a so-called diode bridge which utilizes, for instance, four diodes D1.

The inverter circuit 33 includes, for instance, two switching elements Q1 and Q2 and is connected in series with an output side of the rectifier circuit 31. Here, a field effect transistor is used for each of the switching elements Q1 and Q2, and a gate of each of the field effect transistors is connected to a control unit IC.

The control unit IC outputs control signals to the switching elements Q1 and Q2 when current flows through the lighting circuit 11 such that each of the switching elements Q1 and Q2 repeatedly switches between an ON state and an OFF state at predetermined intervals. In specific, when one switching element switches to the ON state, the other switching element switches to the OFF state.

In addition, a smoothing circuit is connected between the rectifier circuit 31 and the inverter circuit 33. Here, the smoothing circuit is an electrolytic capacitor CD1.

The inductor L and the resonant capacitor C1, which compose the resonant circuit 35, are connected in series with an output side of the inverter circuit 33 with the light-emitter 39 in between.

The light-emitter 39 includes LED series connection groups 41 and 43, each of which is composed of multiple LEDs 18 connected in series in a forward direction. Here, the LED series connection group 41 and the LED series connection group 43 are connected in parallel such that a forward direction of the LEDs 18 in the LED series connection group 41 is a reversal of a forward direction of the LEDs 18 in the LED series connection group 43.

In addition, although the inverter circuit 33 in this example is a so-called series inverter including the two switching elements Q1 and Q2 as described above, the inverter circuit 33 may alternatively be composed of one switching element and an inductor.

(3) Operation

When alternating power is supplied from a commercial power supply via the base 28, the rectifier circuit 31 rectifies the alternating power and converts the alternating power into direct power. The direct power is then smoothed by the smoothing circuit, and smoothed direct power is output to the inverter circuit 33. The control unit IC outputs ON/OFF signals at predetermined intervals to the switching elements Q1 and Q2 when current flows through the lighting circuit 11 (i.e. when voltage is applied to the lighting circuit 11).

As a result, high-frequency power is output to the resonant circuit 35. Further, voltage is stepped-up by the resonant circuit 35, and high voltage is applied to the LEDs 18 of the light-emitter 39.

More specifically, when the switching element Q1 is in the OFF state and the switching element Q2 is in the ON state, current flows from the inductor L to the LED series connection group 43, and to the resonant capacitor C1. Accordingly, the resonant capacitor C1 is electrically charged.

Subsequently, when the switching element Q1 switches to the ON state and the switching element Q2 switches to the OFF state after a predetermined interval of time, the resonant capacitor C1 discharges, and current flows from the resonant capacitor C1 to the LED series connection group 41, and to the inductor L. Further, when the predetermined interval elapses once again, the switching element Q1 switches to the OFF state and the switching element Q2 switches to the ON state, and current flows once again from the inductor L to the LED series connection group 43, and to the resonant capacitor C1. By the switching elements Q1 and Q2 repeatedly and alternately switching between the ON/OFF states in such a manner, current flows through the LED series connection groups 41 and 43 in alternation, thereby putting the light-emitter 39 in a continuously-lit state.

(4) Advantageous Effects

In the lighting circuit 11 having the above-described configuration, the inductor L and the resonant capacitor C1, which compose the resonant circuit 35, are connected in series with the multiple LEDs 18 of the light-emitter 39. Hence, the resonance characteristics of the resonant circuit 35 are determined according to two parameters, namely the inductor L and the capacitor C1. Thus, the process of designing the resonant circuit is facilitated.

3. Modifications (1) Modification 1

Although the above-described configuration is the basic configuration of the lighting circuit pertaining to the present invention, various effects are yielded by additionally providing a capacitor or the like to the lighting circuit. In the following, explanation is provided of modification 1, which is an example of a lighting circuit additionally provided with a capacitor.

Figure 4:
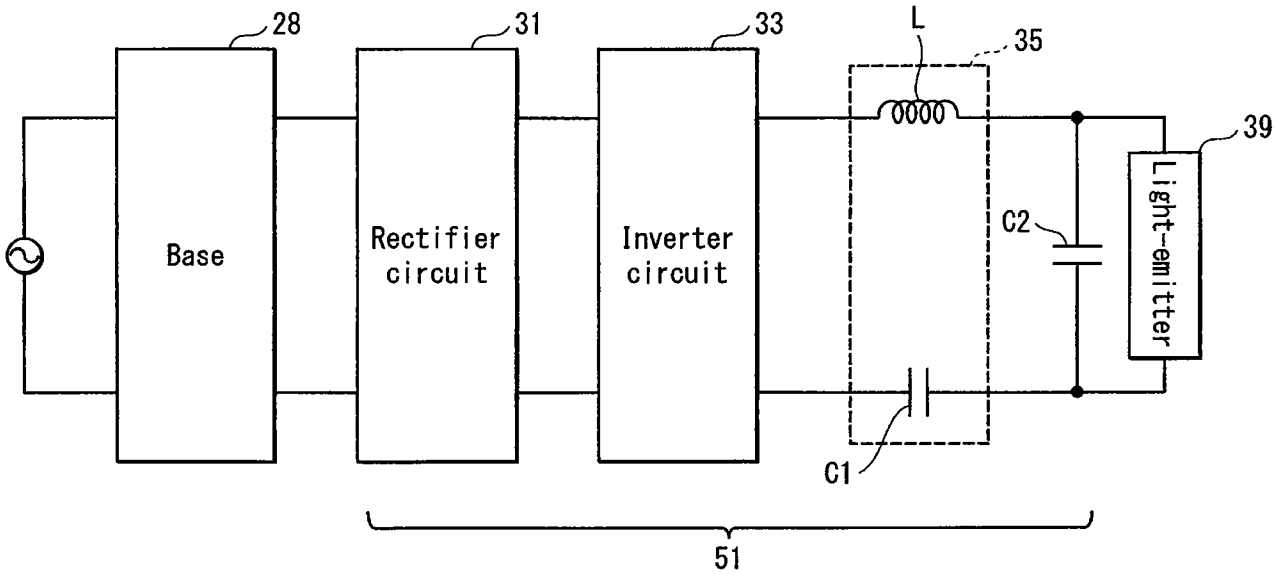
FIG. 4 is a block diagram illustrating a lighting circuit pertaining to modification 1.
Figure 5:
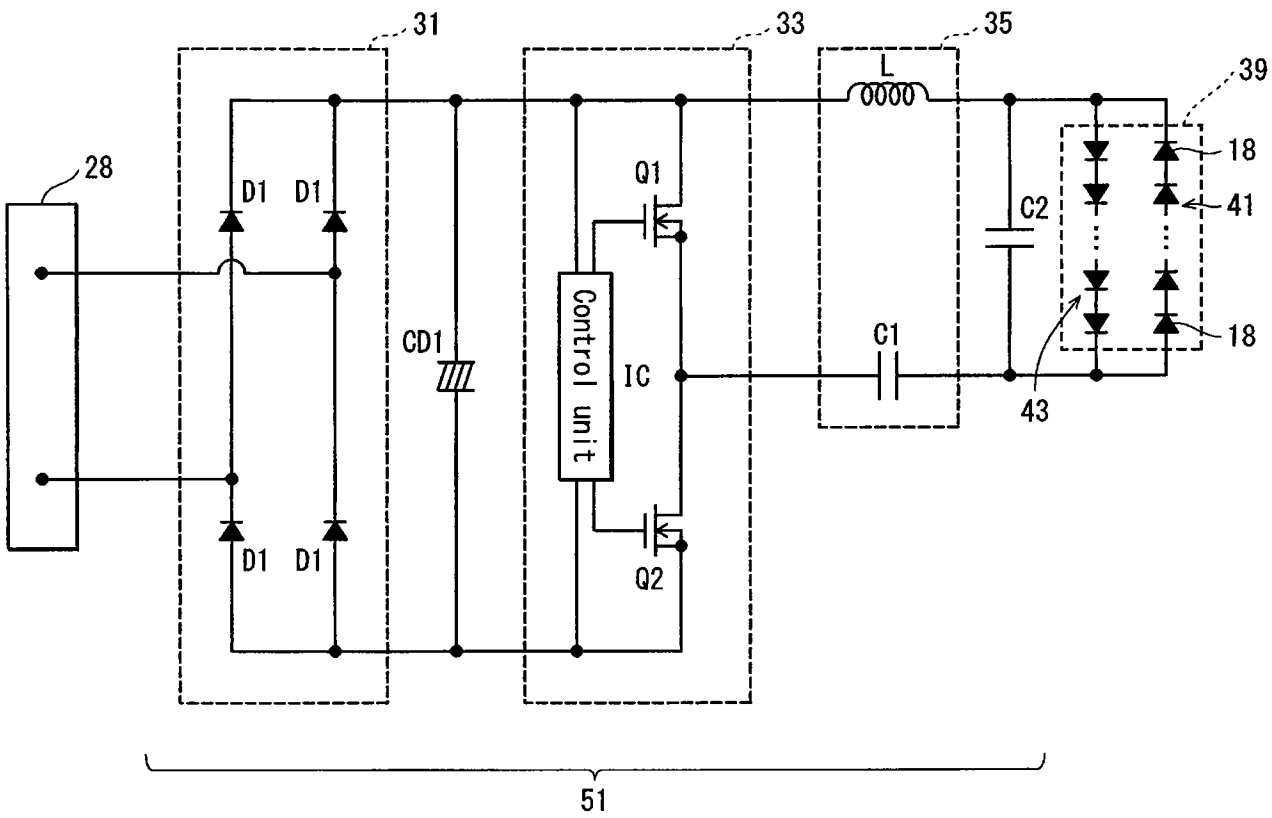
FIG. 5 is a circuit diagram illustrating a configuration of the lighting circuit pertaining to modification 1.

FIG. 4 is a block diagram illustrating a lighting circuit pertaining to modification 1, and FIG. 5 is a circuit diagram illustrating a configuration of the lighting circuit pertaining to modification 1.

A lighting circuit 51 pertaining to modification 1 differs from the lighting circuit 11 in that a capacitor C2, which is connected in parallel with the multiple LEDs 18, is included.

The additional provision of the capacitor C2 to the lighting circuit 51 is advantageous in such a case as where a problem such as disconnection occurs within the light-emitter 39, and the lighting circuit 51 accordingly enters an open-circuit state. In such a case, when the lighting circuit additionally includes the capacitor C2, various electronic components can be destroyed by the high voltage stepped up by the resonant circuit 35 and circuit functions can be stopped. Detailed explanation is to be provided in the following concerning this point.

When the multiple LEDs 18 composing the light-emitter 39 are connected normally and no disorders are found with the other electronic components included in the lighting circuit, or that is, when the lighting circuit is in a normal lit-state, the contribution of the capacitor C2 to the lighting circuit 51 is low. This is since not much current flows through the capacitor C2, which is connected in parallel with the light-emitter 39.

On the other hand, when a problem such as disconnection, for example, occurs with respect to the multiple LEDs 18 composing the light-emitter 39 or to the wiring (conduction path) connecting the LEDs 18, no current is able to flow through the light-emitter 39. Hence, the parallel circuit composed of the capacitor C2 and the light-emitter 39 becomes a circuit including only the capacitor C2.

In consequence, a series connection is established between the inductor L and the capacitors C1 and C2. This leads to a decrease in capacitor capacity, and further, the capacitor C2 contributes to a greater extent to the resonance characteristics of the resonant circuit due to the disconnection within the light-emitter 39.

Hence, when the lighting circuit has a circuit configuration for operating in a different frequency from the resonance frequency of the resonant circuit 35 in a normal lit-state, the voltage stepped-up by the resonant circuit 35 exceeds the voltage during the normal lit-state due to the capacitor C2 contributing to a greater extent as described above when disconnection occurs within the light-emitter 39.

As such, by providing the lighting circuit with electronic components, such as an inductor, having withstand voltages falling below the voltage stepped-up by the resonant circuit 35 when disconnection occurs within the light-emitter 39, it is possible to cause the circuit functions of the lighting circuit to stop safely. This is since the electronic components having low withstand voltages will be destroyed by the disorder of the light-emitter 39 (disconnection of the light-emitter 39).

In addition, voltage of the light-emitter 39, or that is, the voltage applied to the light-emitter 39 is set according to the number of LEDs 18 provided. As such, by adjusting the capacity of the capacitor C2 connected in parallel with the light-emitter 39 according to the voltage of the light-emitter 39, the resonant circuit will be able to support various types of light-emitters 39 (i.e. LED lamps of different specifications).

That is, by adjusting the capacity of the capacitor C2 according to the voltage of the light-emitter 39, the resonant circuit will be able to support various light-emitters 39. Here, it is to be noted that such an adjustment can be made without altering the specifications of the inductor L and the resonant capacitor C1 composing the resonant circuit 35.

In addition, a lower limit of the actual resonance frequency is to be set such that flickering of the LEDs 18 is not visible or hardly visible. In specific, the resonance frequency is to be set to (i) equal to or higher than 101 Hz or (ii) equal to or higher than 121 Hz. Further, to provide an example of a more practical range of frequency for the resonance frequency, a range of 25 kHz to 100 kHz, which is a frequency range of fluorescent lamp power supplies, is preferable.

On the other hand, the upper limit of the resonance frequency may be set to 13.56 MHz, which is frequency used by electrodeless lamps and the like, 2.56 MHz, which is a reserved frequency of the ISM band, or the like.

Further, the lighting circuit includes a resonant circuit having improved circuit efficiency. The resonant circuit, when compared with a conventional direct-current smoothing LED lighting circuit having one switching element, has reduced switching loss. Hence, especially when operated at high output, the circuit efficiency of the resonant circuit improves. In specific, a circuit efficiency of 90% or higher is realized, whereas a conventional circuit having one switching element has a circuit efficiency of around 85%. Further, when the circuit efficiency of the resonant circuit is improved as explained in the above, the heat management of the entire lamp is facilitated. In addition, the resonant circuit contributes to the downsizing of a lamp for having a simple circuit configuration, and further, can be realized at a low cost.

(2) Modification 2

In the explanation having been provided up to this point, field effect transistors (FETs) are used for the switching elements Q1 and Q2, and the switching of the switching elements is controlled by the control unit IC. However, other elements may be used for the switching elements, and further, the switching of the switching elements may be realized by using components other than a control unit utilizing an IC.

Figure 6:
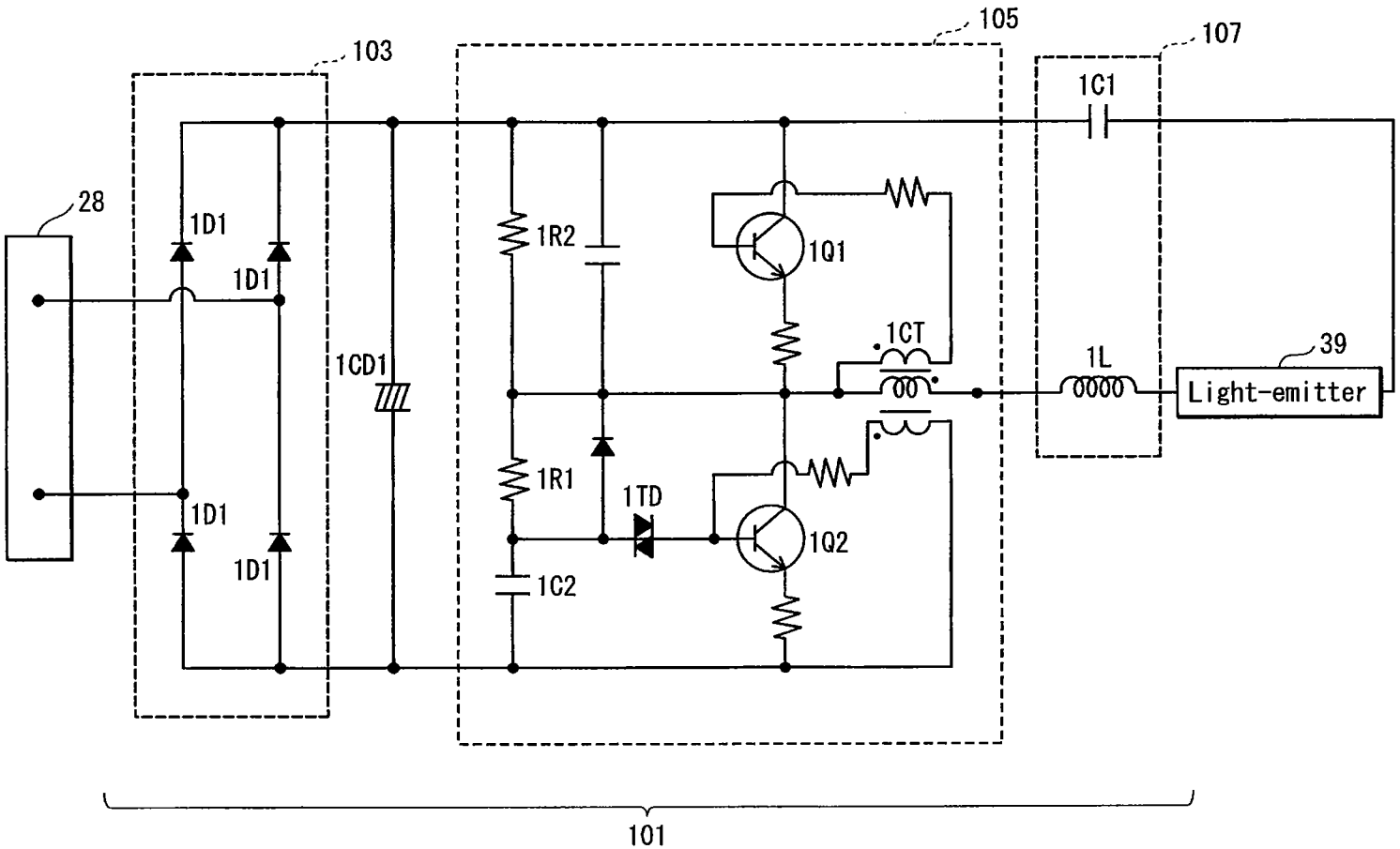
FIG. 6 is a circuit diagram illustrating a configuration of a lighting circuit pertaining to modification 2.

FIG. 6 is a circuit diagram illustrating a configuration of a lighting circuit pertaining to modification 2.

A lighting circuit 101 includes a rectifier circuit 103, a smoothing circuit, an inverter circuit 105, a resonant circuit 107, etc.

The rectifier circuit 103 includes four diodes 1D1, similar as in the first embodiment, and the smoothing circuit includes an electrolytic capacitor 1CD1, similar as in the first embodiment. Further, the resonant circuit 107 includes an inductor 1L and a resonant capacitor 1C1 and is connected in series with the light-emitter 39, similar as in the first embodiment.

The inverter circuit 105 includes a switching element 1Q1 and a switching element 1Q2, which compose a pair and are connected in series with an output side of the smoothing circuit. In modification 2, a transistor is used for each of the switching elements 1Q1 and 1Q2.

The inverter circuit 105 supplies high frequency voltage to the resonant circuit 107 and the light-emitter 39 by the switching elements (transistors) 1Q1 and 1Q2 alternately switching between an ON state and an OFF state in a similar manner as in the first embodiment. That is, the switching elements switch between the ON/OFF states such that when the switching element 1Q1 is in the ON state, the switching element 1Q2 is in the OFF state and when the switching element 1Q1 is in the OFF state, the switching element 1Q2 is in the ON state.

The switching of the switching elements 1Q1 and 1Q2 is performed by a current transformer 1CT. The current transformer 1CT includes one primary coil and two secondary coils. The secondary coils each induce a voltage in accordance with a magnitude and a direction of a load current flowing through the primary coil.

When referring to the circuit configuration illustrated in FIG. 6, a load current flowing through the primary coil when the transistor 1Q1 is in the ON state induces voltages in the secondary coils, and accordingly, the transistor (1Q1) switches to the OFF state and the transistor 1Q2 switches to the ON state. On the other hand, a load current flowing through the primary coil when the transistor 1Q2 is in the ON state induces voltages in the secondary coils, and accordingly, the transistor 1Q2 switches to the OFF state and the transistor 1Q1 switches to the ON state.

The switching of the transistors 1Q1 and 1Q2 is triggered by a trigger circuit, which includes resistors 1R1 and 1R2, a trigger capacitor 1C2, and a trigger diode 1TD. The resistors 1R1 and 1R2 are connected in series with the trigger capacitor 1C2, and a connection node between the resistor 1R1 and the trigger capacitor 1C2 is connected to a base of the transistor 1Q2 via the trigger diode 1TD.

Note that, in FIG. 6, the inverter circuit 105 of modification 2 is illustrated so as to include the trigger circuit in addition to the pair of switching elements 1Q1 and 1Q2.

Second Embodiment

1. Description of Embodiment

Although a series inverter circuit is used in the lighting circuit of the first embodiment, other types of inverter circuits may be used in the lighting circuit pertaining to the present invention. In the second embodiment, explanation is provided of a lighting circuit including a half-bridge inverter circuit.

Figure 7:
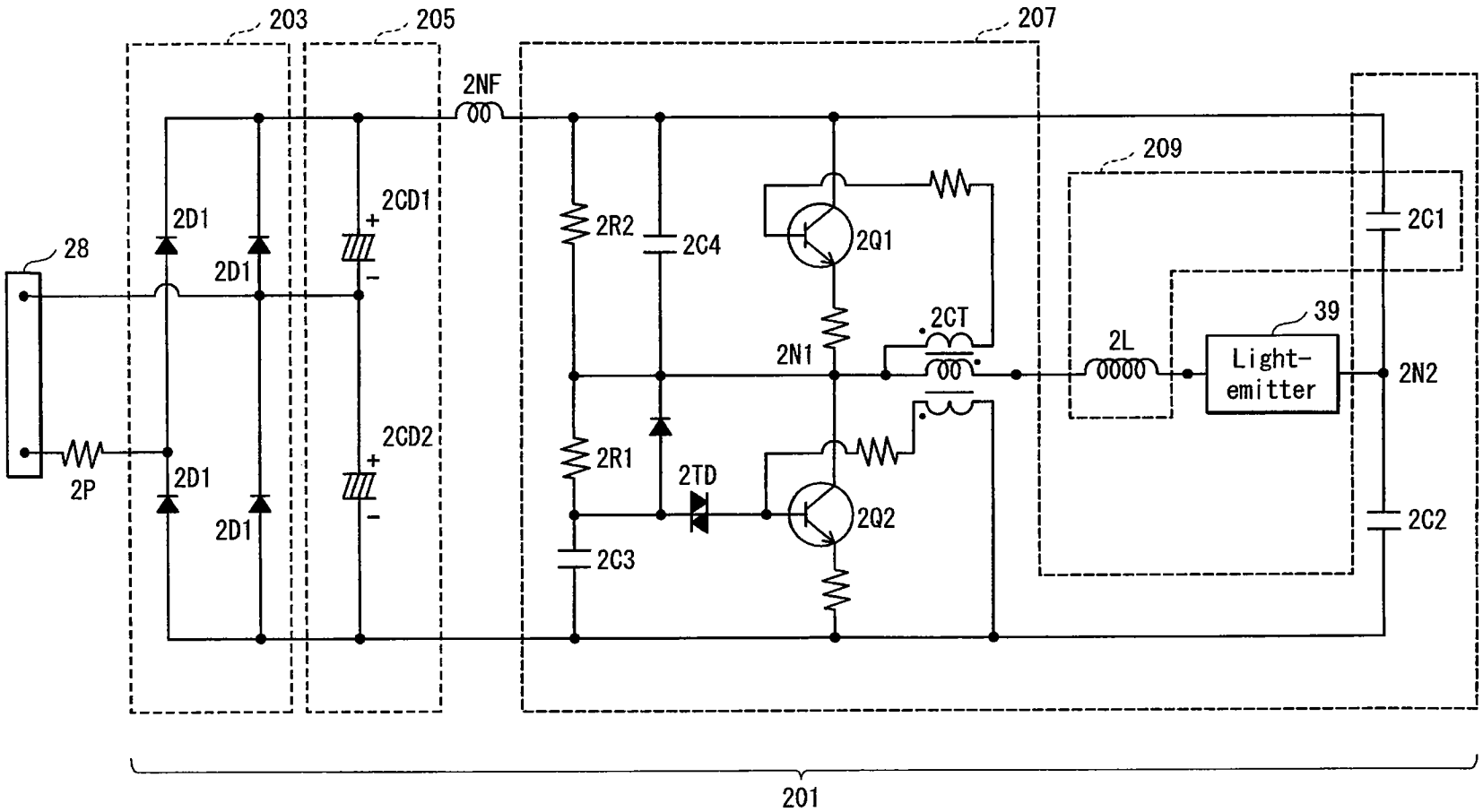
FIG. 7 is a circuit diagram illustrating a configuration of a lighting circuit pertaining to a second embodiment.

FIG. 7 is a circuit diagram illustrating a configuration of a lighting circuit pertaining to the second embodiment.

A lighting circuit 201 includes, as the main components thereof: a rectifier circuit 203; a smoothing circuit 205; an inverter circuit 207; and a resonant circuit 209. In addition, the light-emitter 39 is connected in between an inductor 2L and a resonant capacitor 2C1, which compose the resonant circuit 209. Here, it should be noted that, although the light-emitter 39 is illustrated as being included in the lighting circuit 201 in FIG. 7 for the sake of facilitating illustration, the light-emitter 39 is not actually included as a component of the lighting circuit 201.

The rectifier circuit 203 includes four diodes 2D1, similar as the rectifier circuit 31 of the first embodiment. The smoothing circuit 205 is a so-called voltage doubler including two electrolytic capacitors 2CD1 and 2CD2 that are connected in series. Hence, the output voltage of the smoothing circuit 205 is approximately twice the output voltage of the smoothing circuit (electrolytic capacitor CD1) of the first embodiment.

The lighting circuit 201 is connected to a commercial power supply via the base 28. In addition, an inrush current prevention resistor 2P is connected in between the base 28 and the rectifier circuit 201, or in other words, to an input side of the rectifier circuit 203.

The inverter circuit 207 is a so-called half bridge inverter including a pair of switching elements 2Q1 and 2Q2 and a pair of coupling capacitors 2C1 and 2C2.

Each of the pair of switching elements 2Q1 and 2Q2 and the pair of coupling capacitors 2C1 and 2C2 is connected in series with an output side of the smoothing circuit 205. Further, the inductor 2L and the light-emitter 39 are connected in series in between (i) a connection node 2N1 between the switching elements 2Q1 and 2Q2 and (ii) a connection node 2N2 between the coupling capacitors 2C1 and 2C2. Note that the coupling capacitor 2C1 also serves as the resonant capacitor composing the resonant circuit 209, as is described in the following.

In the second embodiment, transistors are used for the switching elements 2Q1 and 2Q2, similar as in modification 2 of the first embodiment, and further, the switching of the switching elements 2Q1 and 2Q2 is controlled by a current transformer 2CT, similar as in modification 1 of the first embodiment. Further, the switching is triggered by a trigger circuit, which is similar to the trigger circuit described in modification 2. However, the present embodiment differs from such modifications of the first embodiment in that a snubber capacitor 2C4 is connected in parallel with a resistor 2R2 of the trigger circuit.

Note that illustration is provided in FIG. 7 such that the trigger circuit is included in the inverter circuit 207 of the second embodiment.

In addition, a filter coil 2NF is connected in between the inverter circuit 207 and the smoothing circuit 205. The provision of the filter coil 2NF in between the inverter circuit 207 and the smoothing circuit 205 prevents entry of noise from the commercial power supply.

The resonant circuit 209 includes the inductor 2L and the coupling capacitor 2C1, which are connected in series. The coupling capacitor 2C1 is one among the pair of coupling capacitors.

In the lighting circuit 201 having the above-described circuit configuration, the resonant circuit 209 includes the inductor 2L and the resonant capacitor 2C1 connected in series, and further, the resonant circuit 209 is connected in series with the light-emitter 39, similar as in the lighting circuit 11 of the first embodiment. Hence, the process of designing the resonant circuit is facilitated.

In addition, in the second embodiment, the coupling capacitor 2C2, of the pair of coupling capacitors, is connected to an emitter of the switching element 2Q2. As such, the coupling capacitor 2C2 removes switching noise generated by the switching elements 2Q1 and 2Q2 included in the inverter circuit 207. Hence, outflow of noise generated in the inverter circuit 207 to outside the inverter circuit 207 is prevented.

Further, since the filter coil 2NF is connected to an input side of the inverter circuit 207, an LC filter is formed by the filter coil 2NF and the coupling capacitor 2C2. The LC filter prevents switching noise from being superimposed onto the commercial power supply.

In addition, when the switching is triggered within the inverter circuit 207, the switching elements 2Q1 and 2Q2 are caused to repeatedly and alternately switch between the ON/OFF states in a manner as described in the above by voltage output from the current transformer 2CT being applied. The switching of the switching elements 2Q1 and 2Q2 from the ON states to the OFF states requires a predetermined interval of time, which derives from characteristics inherent to switching elements. Further, current flowing immediately before the switching to the OFF states of the switching elements also flows through the inductor 2L, thereby bringing about a slight time lag between the switching of the switching elements and the switching of voltage and current. This leads to power loss in the switching elements 2Q1 and 2Q2, but since the snubber capacitor 2C4 is provided in the present embodiment, the occurrence of power loss in the switching elements 2Q1 and 2Q2 is suppressed.

2. Modification 3

According to the above-presented explanation, the lighting circuit 201 of the second embodiment is provided with the inverter circuit 207, which is a half bridge inverter, and a pair of switching elements 2Q1 and 2Q2. However, the switching elements may be provided in a packaged state. In modification 3 described in the following, explanation is provided of an example where a packaged IC is used in the lighting circuit.

Figure 8:
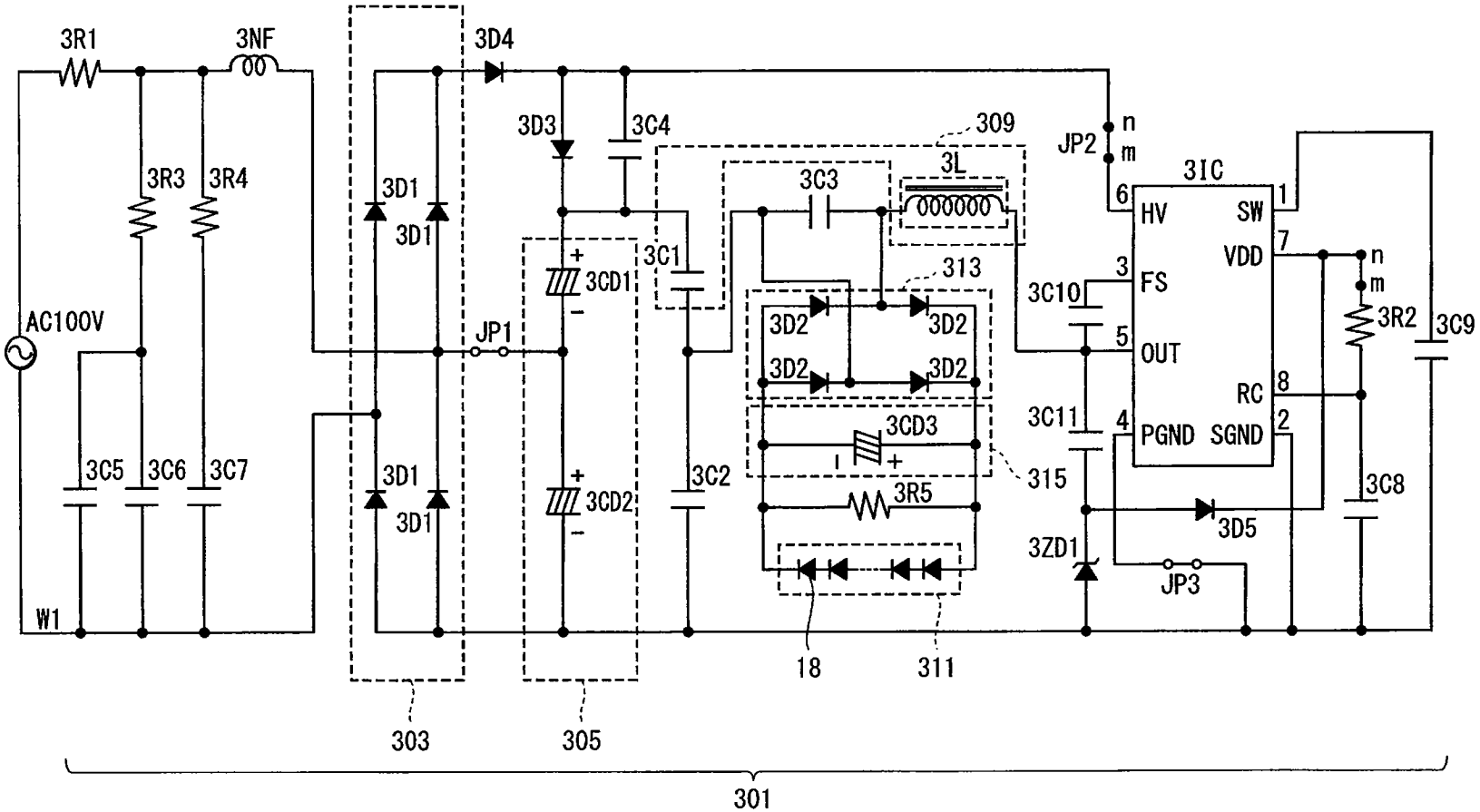
FIG. 8 is a circuit diagram illustrating a configuration of a lighting circuit pertaining to modification 3.

FIG. 8 is a circuit diagram illustrating a configuration of a lighting circuit pertaining to modification 3.

A lighting circuit 301 pertaining to modification 3 includes a rectifier circuit 303, a smoothing circuit 305, an inverter circuit, a resonant circuit 309, a light-emitter 311, etc. Note that, although the light-emitter 311 is illustrated as being included in the lighting circuit 301 in FIG. 8 for the sake of facilitating illustration, the light-emitter 311 is not actually included as a component of the lighting circuit 301.

Each of the rectifier circuit 303, the smoothing circuit 305, and the resonant circuit 309 has a structure as already described in the above.

The inverter circuit of modification 3 is a so-called half bridge inverter, similar to the inverter circuit 207 of the second embodiment. However, the inverter circuit of modification 3 differs from the inverter circuit 207 in that the inverter circuit of modification 3 includes a pair of switching elements and a pair of coupling capacitors 3C1 and 3C2, and further, utilizes an integrated circuit 3IC, in which the pair of switching elements is packaged. Here, note that the switching of the pair of switching elements is controlled by a control unit packaged in the integrated circuit 3IC along with the pair of switching elements.

Alternating power received from the inverter circuit is output from an "OUT" terminal of the integrated circuit 3IC. More specifically, the "OUT" terminal of the integrated circuit 3IC is connected to the inductor (choke coil) 3L and further, a PGND terminal of the integrated circuit 3IC is connected to the coupling capacitor 3C2. Hence, a half bridge inverter circuit is formed.

The rectifier circuit 303 is a diode bridge composed of 4 diodes 3D1. The smoothing circuit 305 includes two electrolytic capacitors, namely 3CD1 and 3CD2, which are connected in series.

As explanation has been provided up to this point, the light-emitter 311 is connected in series with the resonant circuit 309, which includes a choke coil 3L and a resonant capacitor (coupling capacitor) 3C1 which are connected in series. Further, the light-emitter 311 of modification 3 includes one series connection group, which includes a plurality of LEDs 18 connected in series.

In addition, the light-emitter 311 is connected in parallel with the rectifier circuit 313 and the smoothing circuit 315. The rectifier circuit 313 rectifies and converts alternating power output from the inverter circuit into direct power, and the smoothing circuit 315 performs smoothing with respect to the direct power so yielded. Hence, although the light-emitter 311 is provided as a single series connection group, lighting of the light-emitter 311 is performed for both directions of the alternating power.

Here, note that the rectifier circuit 313 is composed of four diodes 3D2, similar to the rectifier circuit 303, and the smoothing circuit 315 is composed of an electrolytic capacitor 3CD3.

Further, a capacitor 3C3 having the same effects as the capacitor C2, explanation of which has been provided in modification 1, is connected in parallel with the light-emitter 311.

In the present example, a parallel circuit including a diode 3D3 and a capacitor 3C4 is connected in series with the smoothing circuit 305 so as to improve the power factor of the lighting circuit. By the parallel circuit being provided, the phase difference between voltage and current of the resonant capacitor (coupling capacitor) 3C1 and the rectifier circuit 303 is adjusted, and a sine wave is generated. Hence, the power factor of the lighting circuit is improved.

Modifications

Although description has been provided in the above on the present invention with reference to embodiments and modifications of the embodiments (to be referred to hereinafter as "embodiments and the like"), the present invention is not limited to such embodiments and the like, and various modifications as described in the following are construed as being included within the scope of the present invention.

1. Inverter Circuit

In the embodiments and the like, explanation has been provided of the inverter circuit while taking inverter circuits such as a series inverter and a half bridge inverter as examples. However, the inverter circuit may be composed of inverters of other types and may be, for example, a full bridge inverter circuit.

2. Lamp

In the embodiments and the like, explanation has been provided of a bulb-type lamp which does not support the dimming function, which enables the adjustment of brightness of a lamp. However, the present invention may be applied to a lamp supporting the dimming function by being provided with a TRIAC or the like for adjusting the power of the lamp.

Figure 9:
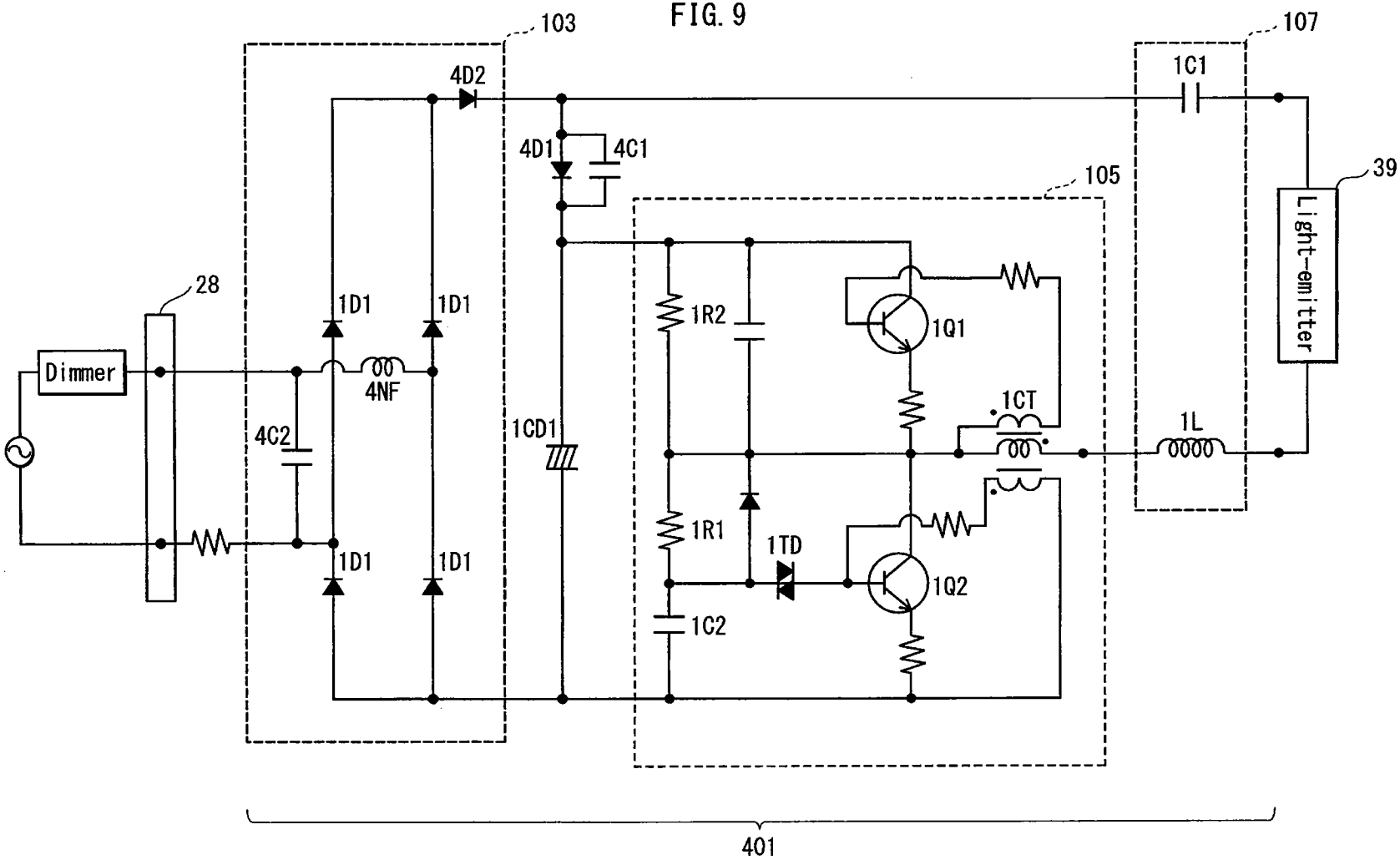
FIG. 9 is a circuit diagram illustrating a configuration of a lighting circuit pertaining to modification 4.

FIG. 9 is a circuit diagram illustrating a configuration of a lighting circuit pertaining to modification 4.

A lighting circuit 401 pertaining to modification 4 is obtained by connecting a diode 4D1 and a capacitor 4C1 in series to the electrolytic capacitor 1CD1 included in the lighting circuit 101 pertaining to modification 2. Here, note that the diode 4D1 and the capacitor 4C1 are connected in parallel. Further, a capacitor 4C2 is connected in parallel with an input side of the rectifier circuit 103.

This configuration of the lighting circuit 401 realizes improvement of power factor during a normal lit-state of the lamp, similar to the configuration of the lighting circuit 201 of the second embodiment. That is, by applying resonance voltage excited by the resonant capacitor 1C1 and the capacitor 4C1 to the diode 4D1, the charging current input to the electrolytic capacitor 1CD1 is provided with a high frequency. Further, by filtering the high frequency components with use of a filter coil 4NF and the capacitor 4C2, a sinusoid input current having a high power factor is obtained.

Further, the lighting circuit 401 having such a circuit configuration is also advantageous in that the lamp provided with the lighting circuit 401, when attached to a lighting fixture having a dimmer, can undergo lighting in dimming mode without bringing about destruction of the lighting circuit 401. This is possible since increase of current effective value is suppressed by the current waveform of the lighting circuit 401 being improved compared to a normal capacitor input waveform and by the power factor being improved for current flowing at zero crossing of voltage (at a point where voltage is zero). In addition, by causing such a current to flow, erroneous operations of a dimmer, or more particularly, erroneous operations of a TRIAC dimmer is prevented.

Here, note that such advantageous effects during lighting in dimming mode can be similarly yielded by the lighting circuit 301 pertaining to modification 3 illustrated in FIG. 8, or that is, the lighting circuit 301 utilizing the integrated circuit 31C having the pair of switching elements packaged therein.

3. Illumination Apparatus

In the above-presented embodiments and modifications, explanation is provided of a bulb-type lamp, which is one example of the lamp pertaining to the present invention. In the following, explanation is provided of an illumination apparatus utilizing the bulb-type lamp. Here, note that the term "bulb-type lamp" is used to describe a lamp which lights even when attached to a lighting fixture for incandescent lamps.

Figure 10:
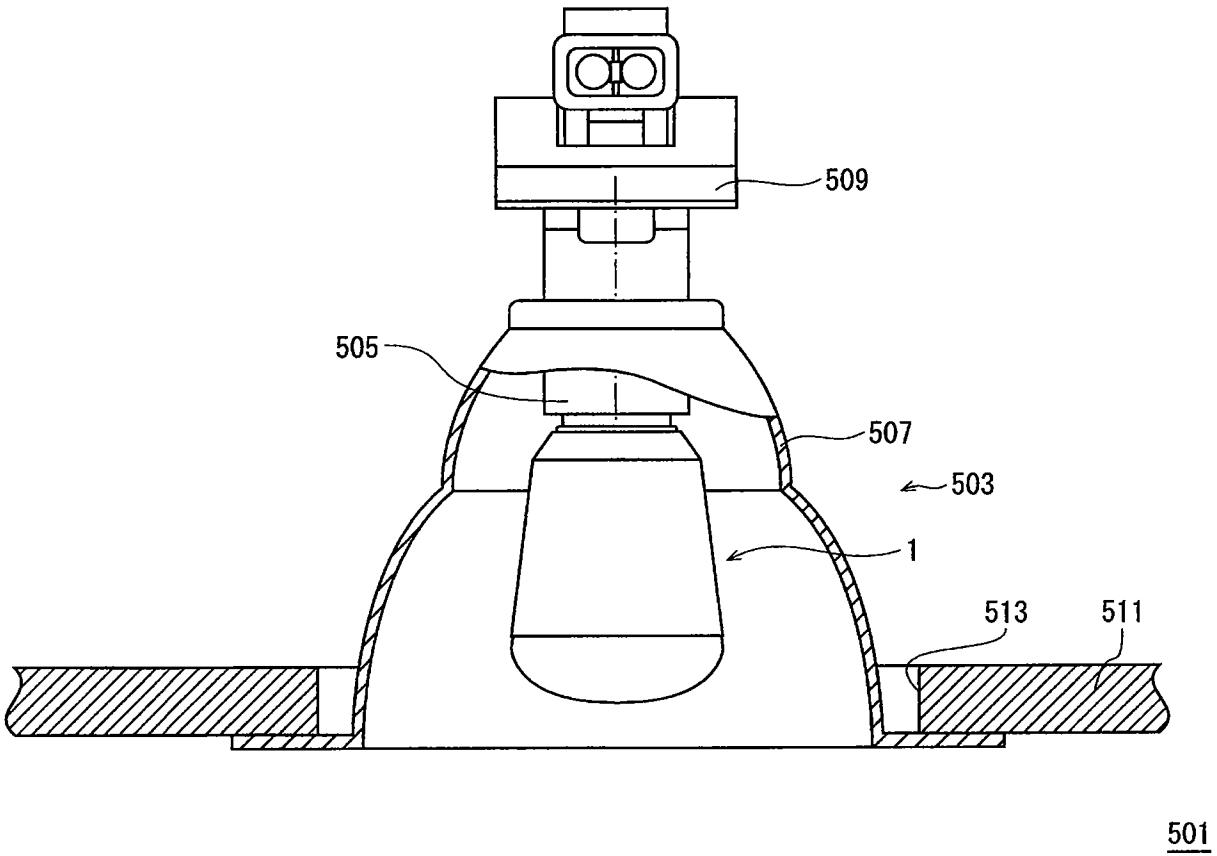
FIG. 10 is a schematic diagram illustrating one example of an illumination apparatus pertaining to the present invention.

FIG. 10 is a schematic diagram illustrating one example of an illumination apparatus pertaining to the present invention.

An illumination apparatus 501 includes the LED lamp 1, explanation of which has been provided in the first embodiment, and a lighting fixture 503. The lighting fixture 503 is a so-called "downlight" lighting fixture.

The lighting fixture 503 includes a socket 505, a reflector 507, and a connector 509. The socket 505 retains the LED lamp 1 while being electrically connected to the LED lamp 1. The reflector 507 reflects light emitted from the LED lamp 1 in a predetermined direction. The connector 509 is connected to a commercial power supply, which is not illustrated in FIG. 10.

Here, the reflector 507 is attached to a ceiling 511 via an opening 513 of the ceiling 511 such that a side of the reflector 507 including the socket 505 is located at a back side (an unexposed side) of the ceiling 511.

Here, note that the illumination apparatus pertaining to the present invention is not limited to the "downlight" lighting fixture as described above. Further, explanation has been provided in the above of a bulb-shaped LED lamp having a lighting circuit, as an example of the illumination apparatus of the present invention. However, the lighting circuit pertaining to the present invention may also be applied to an illumination apparatus that utilizes, as a light source, a lamp that is not provided with a lighting circuit. In other words, the lighting circuit of the present invention may be applied to an illumination apparatus including a lighting circuit.

4. Resonance Frequency and Switching Frequency

In the embodiments and the like, no explanation has been provided of the correlation between a resonance frequency of the resonant circuit and a switching frequency employed for switching between the ON/OFF states of the switching element included in the inverter circuit (referred to hereinafter simply as a "switching frequency"). To provide an explanation of the correlation, in the lighting circuit 51 of modification 1, it is preferable that the switching frequency be lower by approximately 10% compared to the resonance frequency during unloaded condition.

This is since, when several of the LEDs 18 composing the light-emitter 39 short-circuit, voltage of the light-emitter 39 decreases according to the number of LEDs having short-circuited, and accordingly, a fluctuation in resonance frequency is brought about in the lighting circuit 51 pertaining to modification 1. As such, if the switching frequency is set to a value approximating the resonance frequency (for example, in a range of approximately ±5%), there is a risk of the switching frequency approaching the resonance frequency even when merely one of the LEDs 18 of the light-emitter 39 short-circuits. When the switching frequency falls equal to the resonance frequency, a situation may occur where circuit functions stop at a point where only a small decrease in brightness has taken place.

INDUSTRIAL APPLICABILITY

The present invention provides a lighting circuit that is for a lamp including an LED as a light source and that includes a resonant circuit which can be designed with ease.

REFERENCE SIGNS LIST

1 LED lamp
11 lighting circuit
18 LEDs
31 rectifier circuit
33 inverter circuit
35 resonant circuit
39 light-emitter
L inductor
C1 capacitor

The invention claimed is:

1. A lighting circuit that is for a lamp including a light-emitter, the light-emitter including a plurality of Light Emitting Diodes (LEDs) in connected state, the lighting circuit comprising:

a rectifier circuit that rectifies power supplied from an alternating current power supply;

an inverter circuit connected to an output side of the rectifier circuit; and a resonant circuit connected to an output side of the inverter circuit, wherein the resonant circuit includes an inductor and a capacitor and is connected in series with the LEDs, the inductor and the capacitor being connected in series, the lighting circuit further comprises another capacitor, differing from the capacitor included in the resonant circuit, that is connected in parallel with the LEDs, and at least one of electronic components composing the rectifier circuit, the inverter circuit, and the resonant circuit has a withstand voltage that is lower than a voltage stepped up by the resonant circuit when disconnection occurs within the light-emitter.

2. The lighting circuit of claim 1, wherein the inverter circuit is a half-bridge inverter including one pair of switching elements and one pair of coupling capacitors, and the capacitor included in the resonant circuit is one coupling capacitor among the pair of coupling capacitors included in the inverter circuit.

3. An illumination apparatus comprising:

a light-emitter including a plurality of LEDs in connected state; and a lighting circuit that causes the LED to light, wherein the lighting circuit comprises the lighting circuit of claim 1.

4. The lighting circuit of claim 1, wherein the inverter circuit is a half-bridge inverter including one pair of switching elements and one pair of coupling capacitors, and the capacitor included in the resonant circuit is one coupling capacitor among the pair of coupling capacitors included in the inverter circuit.

5. An illumination apparatus comprising:

a lamp including a light-emitter, the light-emitter including a plurality of LEDs in connected state; and a lighting circuit that causes the LEDs to light, wherein the lighting circuit comprises the lighting circuit of claim 1.

6. A lighting circuit for a lamp including a light-emitter having a plurality of Light Emitting Diodes (LEDs) in a connected state, the lighting circuit comprising:

a rectifier circuit that can rectify power supplied from an alternating current power supply;

an inverter circuit connected to an output side of the rectifier circuit; and a resonant circuit connected to an output side of the inverter circuit, wherein the resonant circuit includes an inductor and a capacitor connected in series with the LEDs, the inductor and the capacitor being also connected in series, the lighting circuit further comprises another separate capacitor, differing from the capacitor included in the resonant circuit, that is connected in parallel with the LEDs and is primarily activated in the lighting circuit when a disconnection occurs, and at least one of electronic components composing the rectifier circuit, the inverter circuit, and the resonant circuit has a withstand voltage that is lower than a voltage stepped up by the resonant circuit when disconnection occurs within the light-emitter.

* * * * *